United States Patent [19]

Okuda

[11] Patent Number: 4,616,868

[45] Date of Patent: Oct. 14, 1986

[54] HANDLE WITH CARRYING STRAP

[75] Inventor: Toshio Okuda, Hirakata, Japan

[73] Assignee: 'Totes', Incorporated, Loveland, Ohio

[21] Appl. No.: 694,529

[22] Filed: Jan. 24, 1985

[51] Int. Cl.[4] ..... A45B 25/00

[52] U.S. Cl. ..... 294/137; 135/70 R

[58] Field of Search ..... 294/150, 149, 74, 154, 294/137; 16/118, 119, 125, 126, 122, 123, DIG. 12, DIG. 19; 224/186, 189, 188, 219; 24/115 H, 115 K; D3/12, 10; 135/21, 20 R, 44, 76, 65

[56] References Cited

U.S. PATENT DOCUMENTS

D. 280,677 9/1985 Allen ..... D3/12

3,661,162 5/1972 Weber ..... 135/20 R 4,502,181 3/1985 Gonas ..... 16/126

*Primary Examiner*—James B. Marbert

*Attorney, Agent, or Firm*—Wood, Herron & Evans

[57] ABSTRACT

A handle having a cap and sleeve that cooperate to define a peripheral groove on the handle's exterior surface. The peripheral groove is interrupted by two posts located within the groove and spaced one from the other, each post defining an inner face positioned closer to the handle's axis that the groove's floor. A connector loop portion of a closed loop carrying strap is positioned within the groove, the posts cooperating with slot structure in the groove's floor to deflect the strap interiorly of the handle's wall and then out through a strap slot where a hand loop portion is formed.

8 Claims, 3 Drawing Figures

HANDLE WITH CARRYING STRAP

This invention relates to handles. More particularly, this invention relates to handles of the type that have a carrying strap connected to the handle.

Carrying straps for various products are, of course, very well known to the prior art. The products on which carrying straps are often used include hand held or hand carried products such as cameras, small tape recorders or tape players, small radios, and the like. And the umbrella is another particular retail consumer product on which a handle with a carrying strap is often used. Collapsible type umbrellas sold in the market place today often include a carrying strap connected to the umbrella's handle. This permits the umbrella to be easily carried by the umbrella's owner when it is collapsed, i.e., when its centerpost sections are telescoped together and when its cover is furled, in a fully stored attitude.

It is the primary objective of this invention to provide a novel handle structure with carrying strap in which a closed loop strap is connected to the handle in a peripheral groove on the handle's exterior surface, the strap's hand loop hanging free from the handle at all times. This novel handle structure provides a carrying strap that possesses an enhanced useful life in that it is less likely to break at its point of interconnection with the handle, and provides a handle with carrying strap that is aesthetically pleasing from a visual standpoint.

In accord with this objective, the handle with carrying strap of this invention includes a handle having a cap and sleeve that cooperate to define a peripheral groove on the handle's exterior surface. The peripheral groove is interrupted by two posts located within the grooge and spaced one from the other, each post defines an inner face positioned closer to the handle's axis than the groove's floor. A connector loop portion of a closed loop carrying strap is positioned within the groove, the posts cooperating with slot structure in the groove's floor to deflect the strap interiorly of the handle's wall and then out through a strap slot where a hand loop portion is formed.

Other objectives and advantages of this invention will be more apparent from the following detailed description taken in conjunction with the drawings in which.

Figure 1:
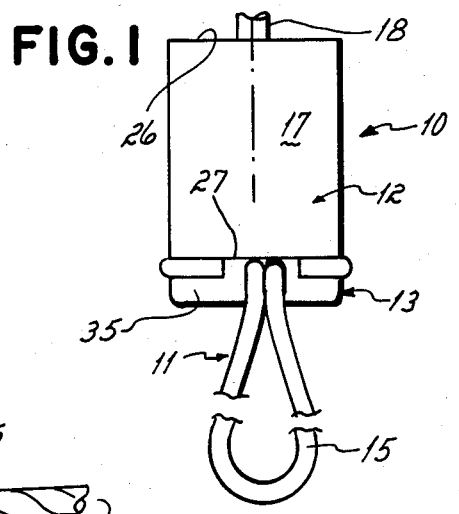
FIG. 1 is a side elevation view illustrating an umbrella handle with carrying strap in accord with the principles of this invention.
Figure 2:
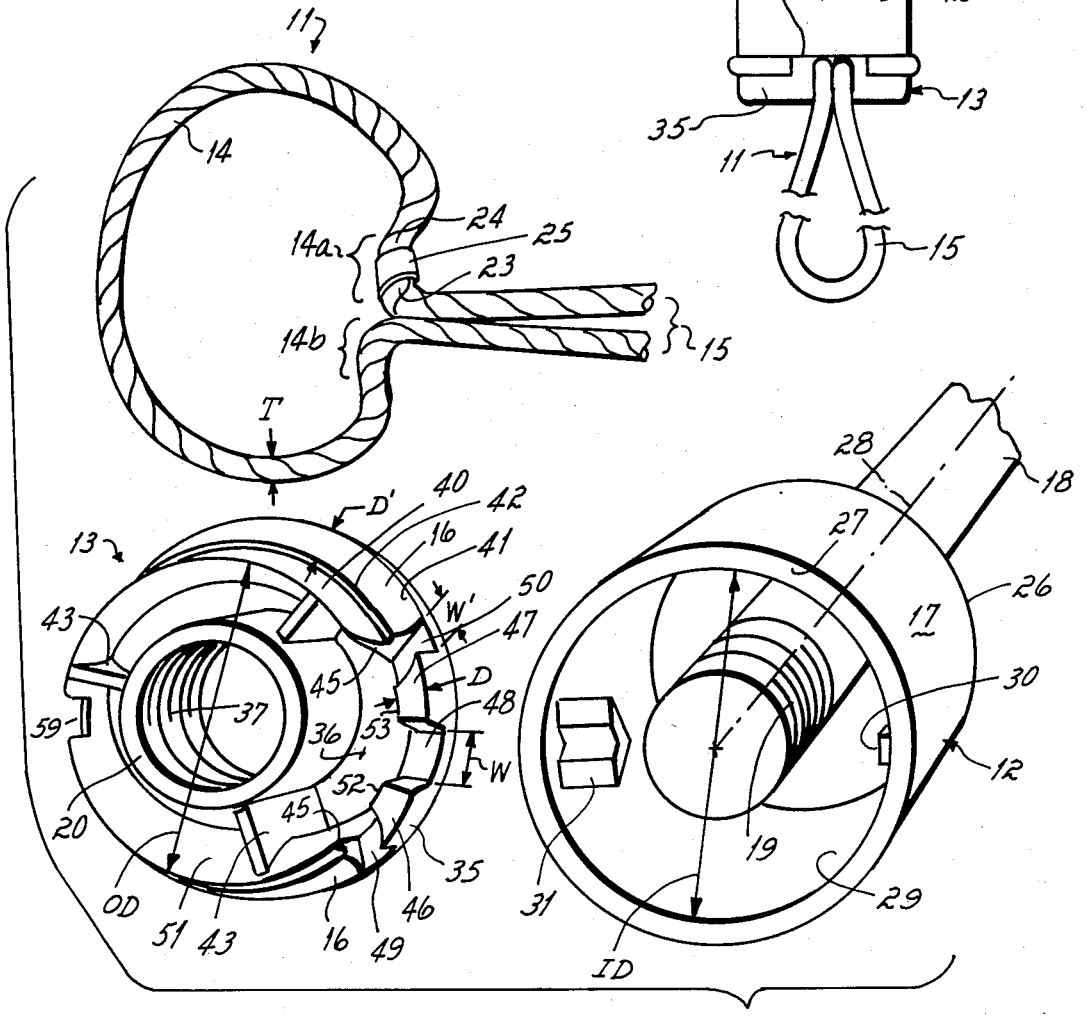
FIG. 2 is an exploded perspective view illustrating the three primary components of the umbrella handle and carrying strap as shown in FIG. 1.
Figure 3:
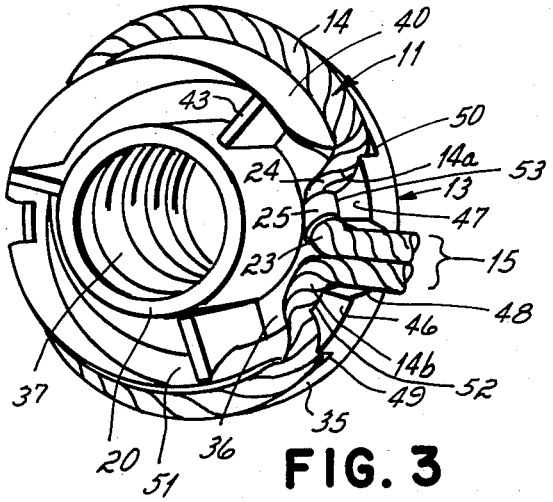
FIG. 3 is a partial assembly top view illustrating the carrying strap and handle cap in assembled configuration.

A handle 10 with carrying strap 11 in accord with the principles of this invention, as shown in FIGS. 1 and 2, basically includes a sleeve 12, a cap 13, and the closed loop carrying strap. The carrying strap 11 includes a connector loop 14 and a hand loop 15, the connector loop being seated in peripheral groove 16 defined by the assembled sleeve 11 and cap 12 on the handle's exterior surface 17 as shown in FIG. 1. This permits the strap's hand loop 15 to hang free at all times. An umbrella centerpost 18 provided with threads 19 at its free end is connected with threaded collar 20 formed integral with the cap 13 in order to connect the handle 10 to an umbrella (not fully shown).

The carrying strap 11 is particularly shown in FIG. 2. The strap 11 is of a flexible material, e.g., a woven cord. The strap 11 comprises the connector loop 14 and the hand loop 15 which are formed from a single closed loop. The strap's single closed loop 14, 15 is formed of a single cord length with the length's two ends 23, 24 being held together by a clip 25. The strap's clipped ends 24, 23 are positioned so as to be part of the strap's connector loop 14, and are positioned interiorly of the handle 10 in the final handle assembly as described in detail below. Accordingly, and even though the carrying strap 11 is comprised of connector loop 14 and hand loop 15, in effect it is of a single closed loop configuration with that overall closed loop being deformed into the connector loop and hand loop sections shown in FIG. 2.

The handle's sleeve 12 is in the form of a cylindrical tube having a cylindrical external surface 17, and having top 26 and bottom 27 edges each disposed normal to the sleeve's longitudinal axis 28. The sleeve's axis 28 is also the axis of the handle 10. The sleeve 12 has an inner surface 29 on which a centering lug 30 and a hold-down plate 31 are formed. The centering lug 30 and hold-down plate 31 extend radially inward from the sleeve's inner surface 29, and cooperate with structure in the handle's cap 13 as described in detail below.

The handle's cap 13 is formed with a cylindrical exterior surface 35 having an outside diameter substantially equal to the outside diameter of the sleeve's cylindrical exterior surface 17 so that, upon assembly, the sleeve and cap provide a common exterior cylindrical surface as shown in FIG. 1. The cap 13 also includes a floor 36 on which the collar 20 is integrally molded. The collar 20 is provided with interior threads 37 adapted to cooperate with the umbrella centerpost's exterior threads 19 so as to interconnect the handle 10 with the umbrella (not shown) after the handle 10 and carrying strap 11 have been assembled.

The cap 13, as previously mentioned, partially defines a groove 16 on the exterior face 35 thereof, that groove having a radial depth D' and extending substantially entirely around the periphery of the cap in a plane generally perpendicular to the cap's axis 28. It is preferable that the depth D' of the peripheral groove 16 be at least equal to about one-half the thickness T of the strap 11, and preferably not greater than the thickness T of the strap. An annular flange 40 extends upward or away from the groove 16 defining structure, that flange having an outside diameter no greater than the inside diameter of the sleeve 12. Note that the flange 40, being radially inwardly offset relative to floor 41 of the groove, cooperates to define a generally annular ledge 42. The outside diameter of the annular flange 40 is not greater than the inside diameter of the sleeve 12 so that when the sleeve and cap 13 are assembled the sleeve's bottom 27 edge rests on the cap's ledge 42 in order to maintain these components in the desired longitudinal assembly position relative one to the other, and so that the cap's flange cooperates with the sleeve's inner surface 29 to maintain those components in the desired lateral assembly position relative one to the other, i.e., relative to the handle's axis 28. Three radially disposed webs 43 are molded integral with the cap's flange 40 and collar 20 for structural reinforcement of the cap 13 structure.

The cap's peripheral groove 16 extends substantially, but not completely, around the exterior periphery thereof. A segment 45 is cut out of the cap's flange 40 and groove 16 structure, and two posts 46, 47 that are spaced one from the other are located in that groove. The posts 46, 47 are spaced one from the other to create a strap slot 48 that is of a width W about twice the thickness T of the strap 11 cord. The strap slot 48 itself is radially oriented relative to the handle's axis 28. Note particularly that the radial depth D of each of the posts 46, 47 is greater that the radial depth D' of the peripheral groove 16, each of the posts thereby presenting an inner face 52, 53, respectively, positioned radially inward of the groove's floor 41, i.e., closer to the handle's axis 28 than the groove's floor 41. Further, the two posts 46, 47 cooperate with the groove 16 and flange 40 structure to establish spaced guide slots 49, 50 one on each side of the strap slot 48. These guide slots 49, 50 each provide an opening from the handle's groove into the handle's hollow interior 51. These guide slots 49, 50 cooperate with the connector loop 14 portion of the strap 11 to guide the cord into the handle's hollow interior 51, i.e., radially inward of the groove's floor 41. The width W' of each of these guide slots 49, 50 is approximately equal to the thickness T of the strap 11.

In assembly of the handle 10, and with the sleeve 12 and cap 13 disconnected one from the other, the pre-cut length of strap 11 cord is first formed into a single loop, it being held as a loop by toothed clips 25. The strap 11 is then preliminarily positioned as shown in FIG. 2, to form a connector loop 14 and the connector loop then laid over the flange 40 of the cap 13 into the peripheral groove 16. The sections **14*a*, 14*b* of the connector loop 14 adjacent the interconnection with the hand loop 15 are then trained or deflected into the handle's interior 51, i.e., interiorly of the peripheral groove 16, by the guide slots 49, 50 and posts 46, 47, and then out of the cap's interior through the strap slot 48, so that the strap's hand loop 15 is located exteriorly of, with the cap 13. Subsequently, the sleeve 12 is assembled with the cap 13, its position being located by interfit of that sleeve's centering lug 30 with centering slot 59 in the cap's flange 40. An adhesive is interposed on the interfit exterior surface of the cap's flange 40 with the sleeve's interior surface 29 so as to maintain the assembly. The hold-down plate 31 on the sleeve 12 overlies the strap slot 48 in the cap so as to provide a closed strap slot. This final assembly, then, provides a handle 10 with carrying strap 11 as shown in FIG. 1 in which the strap's hand loop 15 is firmly connected to the handle 10 by virtue of the handle's posts 46, 47, and slots 48–50, and exterior surface groove 16, and which also provides a pleasing appearance in that the strap's connector loop 14** is substantially exposed to the eyes of a casual observer.

Having described in detail the preferred embodiment of my invention, what I desire to claim and protect by Letters of Patent is:

1. An umbrella handle comprising a carrying strap having a connector loop and a hand loop, said connector and hand loops being defined from a single closed loop strap configuration, a sleeve that defines an exterior peripheral surface which surrounds said handle's longitudinal axis, said sleeve's exterior surface being grippable by a user's hand during normal use of said handle, a cap connectable with said sleeve, said cap defining an exterior end surface which traverses said handle's longitudinal axis, said cap's exterior surface not being grippable by a user's hand during normal use of said handle, structure defining a peripheral groove that extends around the exterior surface of said sleeve, said peripheral groove being partially formed by said sleeve and partially formed by said cap, said carrying strap's connector loop being seated within said peripheral groove, and two posts spaced one from the other within said peripheral groove, said posts cooperating to partially define a strap slot therebetween through which a double thickness of said hand loop extends into the handle's interior, each of said posts also cooperating to partially define a guide slot spaced from said strap slot through which a single thickness of said connector loop extends into the handle's interior, said guide slot structure cooperating with said strap slot structure to define a tortuous path around which a portion of said strap's connector loop must pass, the juxtaposition of said strap's connector loop and said hand loop thereby being positioned internally of said handle.

2. A handle as set forth in claim 1, said strap slot having a width about equal to twice the thickness of said strap, and each of said guide slots having a width about equal to the thickness of said strap.

3. A handle as set forth in claim 1, the depth of said exterior groove being as least equal to about one-half the thickness of said strap.

4. A handle as set forth in claim 3, the depth of said exterior groove being not substantially greater that the thickness of said strap.

5. A handle as set forth in claim 1, said cap having a flange that cooperates with an interior surface of said sleeve for laterally positioning said cap in proper position relative to said sleeve.

6. A handle as set forth in claim 5, said cap defining a ledge that cooperates with a bottom edge of said sleeve for longitudinally positioning said cap in proper position relative to said sleeve, and for defining said exterior groove.

7. A handle as set forth in claim 6, said cap and sleeve having a centering lug carried by one and a centering slot formed in the other, said centering lug and centering slot cooperating to locate said cap in desired rotational position relative to said sleeve.

8. A handle as set forth in claim 1, said cap comprising a collar adapted to interconnect with an umbrella's centerpost.

* * * * *